US005193702A

United States Patent [19]

Shannon

[11] Patent Number: 5,193,702

[45] Date of Patent: Mar. 16, 1993

[54] SAFETY LOCK STORAGE CONTAINER

[76] Inventor: Henry D. Shannon, Box 2014, Michigan City, Ind. 46360-8014

[21] Appl. No.: 747,907

[22] Filed: Aug. 19, 1991

[51] Int. Cl.[5] ..... B65D 21/02

[52] U.S. Cl. ..... 220/23.4; 229/115; 206/551; 220/DIG. 13

[58] Field of Search ..... 229/115; 206/551; 220/23.4, 23.6, 23.83, 23.86, DIG. 13

[56] References Cited

U.S. PATENT DOCUMENTS

| | | | |
|---|---|---|---|
| 781,192 | 1/1905 | Dingwall | 229/115 |
| 3,142,430 | 7/1964 | Meyers | 229/115 |
| 3,800,974 | 4/1974 | Mogel et al. | 220/23.4 |
| 4,401,216 | 8/1983 | Koch | 220/23.4 |
| 4,492,333 | 1/1985 | Roberts | 229/115 |
| 4,512,469 | 4/1985 | West | 220/23.4 |
| 5,076,437 | 12/1991 | Schindler | 206/351 |

*Primary Examiner*—Joseph Man-Fu Moy
*Attorney, Agent, or Firm*—James D. Hall

[57] ABSTRACT

A storage container having one or more individual vessels, which are triangular shaped and able to affix together into side by side container units. A removable strip lock extends through aligned slots in the affixed vessels to secure the lids of the vessels closed and to interlock the vessels against separation.

7 Claims, 2 Drawing Sheets

SAFETY LOCK STORAGE CONTAINER

FIELD OF THE INVENTION

This invention relates to a storage container, having special application and relevance to non-liquid, granular storage container vessels.

SUMMARY OF THE INVENTION

Container and packaging cost reflect a strong percentage of the total consumer cost for many small products and consumable substances. Market demands have required individualized packaging of all varieties of consumer products and substances. Individualized packaging containers cover a wide variety of sizes and configurations. The difficulties with individually packaged containers is the lack of uniformity and the inefficient use of storage and transportation space. In bulk shipments, configurations of conventional individualized containers do not efficiently use available space in the bulk container. At the consumer level, the diversity of shape and sizes in conventional individual vessels inefficiently use self space, while offering little advantage in using the products contained inside them.

This invention provides a containment method for packaging and storing granular substances, such as powders, grains and the like and small piece products, such as nuts, washers, and bearings. The unique design effectively seals the contents of the container, while the contents remain easily accessible. The container has a wedge shaped body with a pivotal lid. The unique wedged shape allows individual vessels to be connected in continuous rows. Removable strips extend through aligned slots in the vessels to secure the lids of the vessels closed and to interlock the vessels against separation. The wedge shaped container rows can be conveniently stored and transported in bulk container packaging with a minimum loss of potential storage or transportation space.

Accordingly, an object of this invention is to provide a novel storage container with a unique vessel shape for storing granular substances and small piece products.

Another object of this invention is to prevent tampering by providing an accessible sealed enclosure which is prevented from opening by retaining strips.

Other objectives of this invention will become apparent upon a reading of the following description.

BRIEF DESCRIPTION OF THE DRAWINGS

A preferred embodiment of the invention has been chosen for illustration wherein.

DESCRIPTION OF THE PREFERRED EMBODIMENT

Figure 2:
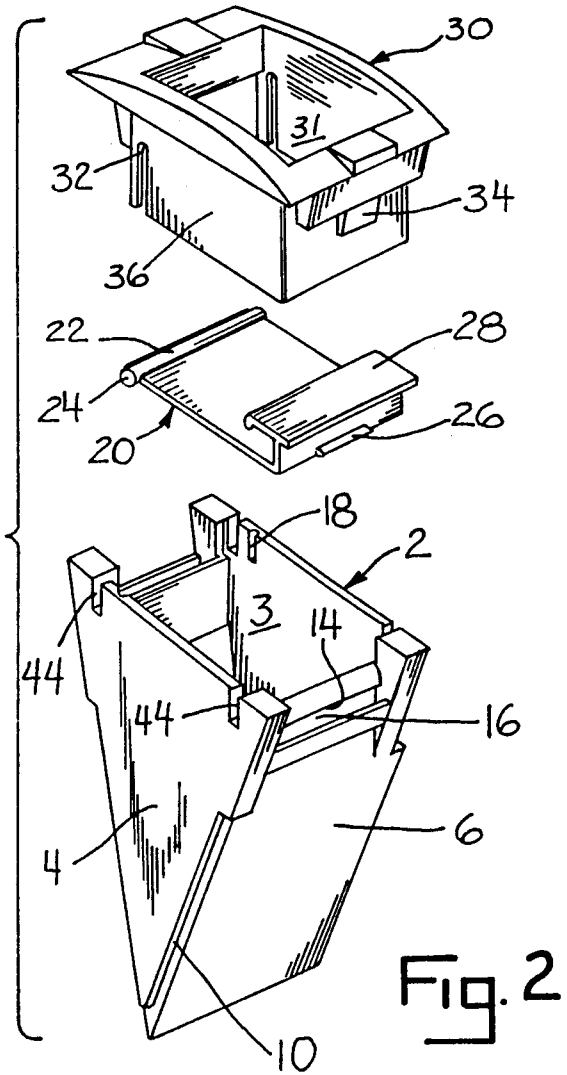
FIG. 2 is an exploded perspective view of the three individual components of a single vessel.

The preferred embodiment herein described is not intended to be exhaustive or to limit the invention to the precise form disclosed. It is chosen and described to explain the principles, application and practical use of the invention to thereby enable others skilled in the art to utilize the invention.

In this invention, each individual vessel 50 includes a base housing 2 defined by a two triangular end walls 4, and two rectangular side walls 6, creating a storage area 3, as seen in FIGS. 1–4. Each vessel 50 includes an upper lid housing 30 having a storage area opening 31 and a pivotal lid 20. Lid housing 30 is fitted into base housing 2 in a snap fit connection. Fastening tabs 34 of housing 30 extend into slots 18 formed in side walls 4 and engage lips 14 of base housing 2.

Figure 1:
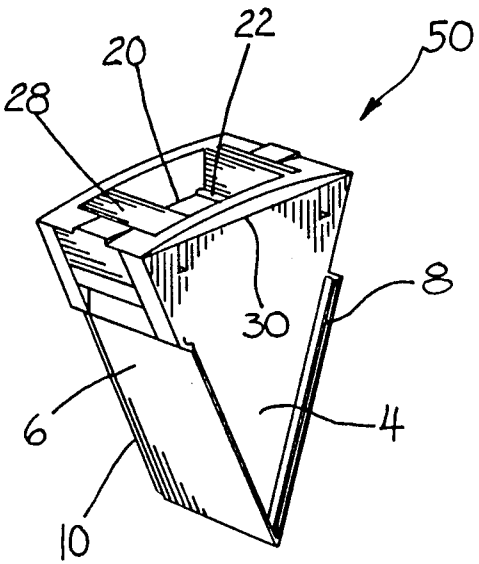
FIG. 1 is a perspective view of a single vessel.
Figure 4:
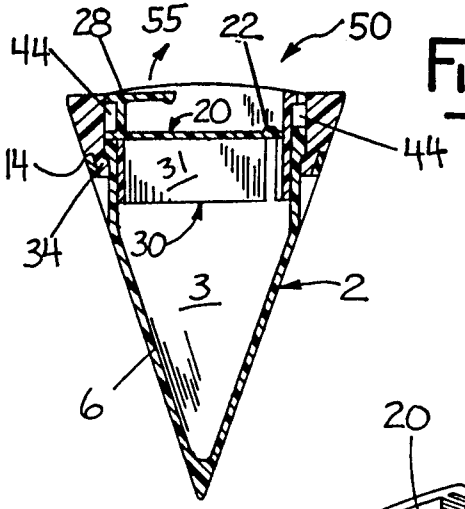
FIG. 4 is a vertical sectional view of a single vessel.
Figure 3:
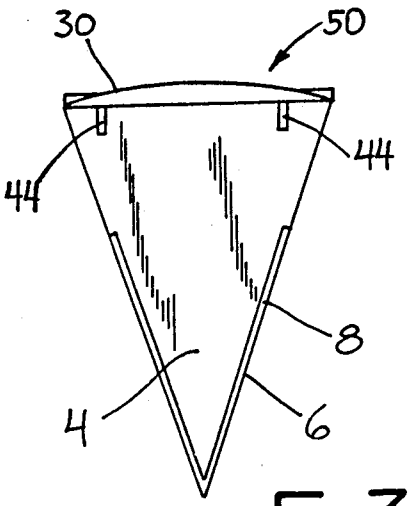
FIG. 3 is a side view of a single vessel.

Lid 20 is pivoted between an open and closed position by an integral pintle 22. Lid 20 is recessed within housing 30 with pintle ends 24 of lid 20 confined within slots 18 formed in end walls 4 of base housing 2 and overlying slots 32 in end walls 36 of lid housing 30. Lid 20 rotates between the open and closed position pivoting on pintle ends 24 recessed between slots 32 and 18. In the closed position, vessel lid 20 rests against lid housing 30 and the base housing 2, sealing the storage area 3 as seen in FIGS. 1 and 4. In the open position, the contents of each vessel 50 is accessible though the opening 31. Lid 20 includes a lifting lip 28.

Removable strips (retaining rods) 40 and 42 pass through strip slots 44 in the end walls 4 of each vessel 50. One strip 42 extends across the free end of the vessel lid 20 between spaced flanges 26 to confine vessel lid 20 against base housing 2 thereby preventing the vessel lid 20 from opening. Removing the strip 42 from its strip slot 44 allows the vessel lid 20 to swing outward in the direction of arrow 55 in FIG. 4.

Figure 6:
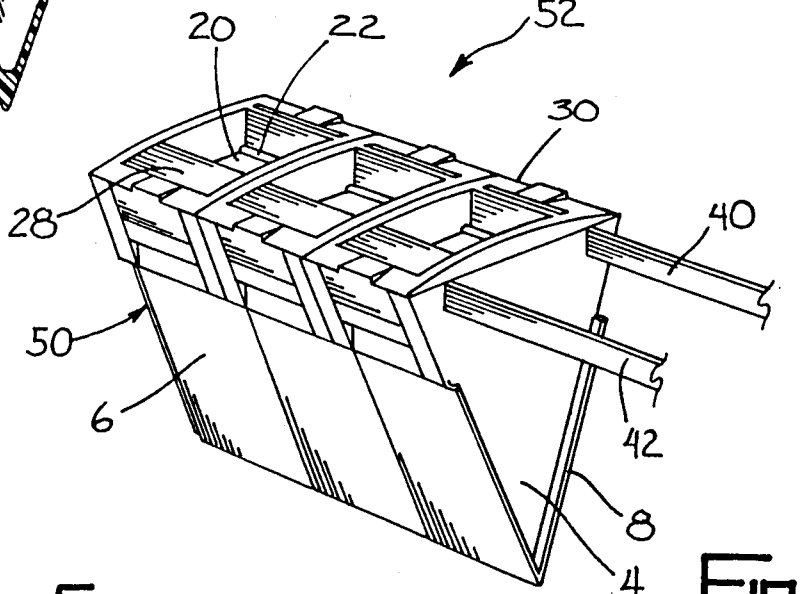
FIG. 6 is a perspective view of three vessels attached by inter-locking grooved end walls and retaining strips.
Figure 5:
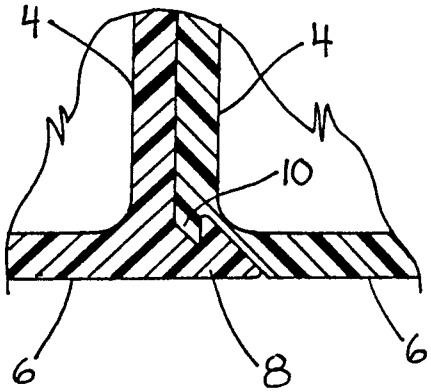
FIG. 5 is an enlarged sectional view of the lateral wall flange and rib interlock of connected vessels.

Vessels 50 are attached together by a snap fit connection to form a container 52. Side walls 6 of base housing 2 extend at corresponding edges beyond one end wall 4 forming opposed a pair of notched ribs 10 formed along the opposite recessed edges of side walls 6. Vessels 50 slide together in face to face end wall positions with ribs 10 of one vessel interlocking within flanges 8 of the adjacent vessel as seen in FIGS. 5 and 6. In this manner, numerous vessels 50 can be interlocked together in a row forming container 52 as seen in FIG. 6. When vessels 50 are so connected, strip slots 44 align of vessels 50 to allow the strips 40 to span container 52, securing all lids 20 and stabilizing the container. In this manner, individual vessels are secured together and their lids are secured against opening.

It is understood that the above description is not intended to limit the invention to the embodiment herein described, but that it may be modified within the scope of the appended claims.

I claim:

1. A container comprising a vessel having a base with two generally parallel V-shaped walls interconnected by two convergent rectangular side walls to define a storage area having an open top, and a lid pivotally connected to said base for covering said top, a second said vessel having a base with two generally parallel V-shaped end walls interconnected by two convergent rectangular side walls to define a storage area having an open top and a lid pivotally connected to said base for covering said top, each vessel including means for interlocking engagement with another said vessel, said vessels being interlocked by mutual engagement of said interlocking means, said vessels each have one of its side walls in substantially parallel face to face alignment with a side wall of another said vessel, said interlocking means including a pair of spaced inturned flanges adjacent one end wall and a pair of spaced notched ribs adjacent the other end wall of each vessel, the spaced flanges of one said vessel being slidably interlocked with the spaced ribs of another said vessel.

2. The container of claim 1 wherein said strip device constitutes means for preventing disengagement of said vessels.

3. The container of claim 2 and a second removable strip device extending through other aligned slots in said bases to secure the vessels against disengagement.

4. The vessel of claim 3 wherein said lid pintles are encased by oppositely aligned slots in said lid housing and said base housing.

5. A vessel comprising a wedge shaped base housing having two generally parallel V-shaped walls interconnected by two convergent rectangular side walls to define a storage area having an open top, a pivotal lid having pintles, and a lid housing connectively engaging said base housing, said lid being pivotally journaled between said lid housing and said base housing are for covering said open top, said lid being pivotal between an open position and closed position.

6. The vessel of claim 5 wherein said lid and base housings are connected by a snapfit interconnection between said housings.

7. A container comprising a vessel having a base with two generally parallel V-shaped walls interconnected by two convergent rectangular side walls to define a storage area having an open top, and a lid pivotally connected to said base for covering said top, a second said vessel having a base with two generally parallel V-shaped end walls interconnected by two convergent rectangular side walls to define a storage area having an open top and a lid pivotally connected to said base for covering said top, each vessel including means for interlocking engagement with another said vessel, said vessels being interlocked by mutual engagement of said interlocking means, said vessels each have one of its side walls in substantially parallel face to face alignement with a side wall of another said vessel, said bases of said interlocking vessels having aligned slots, a removable strip device extending through said slots and engaging said lids of said vessels for preventing said lids from pivoting into open positions exposing said vessel storage areas. v

* * * * *